US006964504B2

(12) United States Patent
Newbold

(10) Patent No.: US 6,964,504 B2
(45) Date of Patent: Nov. 15, 2005

(54) LIGHTING SYSTEM FOR DIRECT WIRING ELECTRIC LUMINAIRES

(75) Inventor: Ron Newbold, Hanahan, SC (US)

(73) Assignee: Hubbell Incorporated, Orange, CT (US)

( * ) Notice: Subject to any disclaimer, the term of this patent is extended or adjusted under 35 U.S.C. 154(b) by 10 days.

(21) Appl. No.: 10/405,107

(22) Filed: Apr. 1, 2003

(65) Prior Publication Data

US 2004/0196651 A1 Oct. 7, 2004

(51) Int. Cl.[7] ..... F21V 17/00
(52) U.S. Cl. ..... 362/375; 362/133; 362/225
(58) Field of Search ..... 362/226, 374, 362/375, 133, 223, 224, 225; 439/76.1, 535, 439/652

(56) References Cited

U.S. PATENT DOCUMENTS 4,875,871 A * 10/1989 Booty et al. ..... 439/209
4,943,900 A 7/1990 Gartner
5,415,564 A * 5/1995 Winter et al. ..... 439/535
5,559,393 A 9/1996 Nilssen
5,658,067 A 8/1997 Engle et al.
5,751,117 A * 5/1998 Abbott ..... 315/244
6,050,708 A 4/2000 Roorda
6,089,884 A 7/2000 Klaus
6,100,643 A 8/2000 Nilssen

* cited by examiner

*Primary Examiner*—John Anthony Ward
(74) *Attorney, Agent, or Firm*—Alfred N. Goodman; Mark S. Bicks

(57) ABSTRACT

A lighting system for direct wiring a plurality of light fixtures is disclosed. The lighting system is particularly well suited for use with portable electric luminaires as classified by Underwriters Laboratories. The lighting system includes a wire modular box that is configured to receive a supply wire from the building or facility where the system is being installed. The wire modular box includes one or more output receptacles. Each light fixture in the system includes a first receptacle and a second receptacle. Cables are then used to electrically connect the wire modular box with the light fixtures.

32 Claims, 5 Drawing Sheets

LIGHTING SYSTEM FOR DIRECT WIRING ELECTRIC LUMINAIRES

BACKGROUND OF THE INVENTION

Underwriters Laboratories, Inc. (UL) is an independent, not-for-profit product safety testing and certification organization. More than 60,000 manufacturers, including the makers of toys, industrial controls, telecommunications equipment, and light fixtures, pay to have their products tested by the non-profit laboratory. Approval of a product by Underwriters Laboratories is a well recognized indication that the product meets certain public safety standards. In fact, UL is one of the most recognized, reputable conformity assessment providers in the world, allowing companies to market their products with a seal of acceptance whether the product is an electrical device, a programmable system, an appliance, an electric tool, or the like.

One classification of UL listed products is portable electric luminaires (UL 153). Portable electric luminaires cover portable luminaires, such as electric lamps and subassemblies, whose primary function is task or ambient illumination. These products are provided with a flexible cord and an attachment plug for connection to standard electrical outlets. The products are intended for use in accordance with the National Electrical Code, ANSI/NFPA 70.

Portable electric luminaires may include, for instance, bulb-type light fixtures including portable lamps, nightlights, portable work lights, and various incandescent-type lamps and fluorescent-type lamps. When classified as a portable luminaire, UL product safety standards dictate that the products are not to be installed in recessed walls or ceilings or in permanently installed cabinets where wiring is concealed or passed through openings in the structure.

Many undercabinet lights are classified by UL as portable luminaires. Such lamps can contain, for instance, a tubular fluorescent bulb having a length of from about 4 inches to about 48 inches and having a diameter of less than about 0.75 inches. For instance, in one embodiment, portable undercabinet light fixtures can include what is referred to as a "T5" fluorescent lamp, which has a diameter of ⅝ inch.

In the past, multiple lamp systems containing a plurality of UL listed portable luminaires have been proposed. Such multiple lamp systems may be desirable, for instance, when illuminating long countertops or other tables situated below a row of cabinets. Since UL safety standards do not permit the portable light fixtures to be hardwired, however, past systems have tended to be somewhat difficult to install and/or to modify after the lights are connected. Further, in many such multiple lamp systems, many wires and cords remain exposed which can look unsightly. In some prior art systems, the multiple lamps are not connected in series but, instead, are independently plugged into various outlets which, not only exposes multiple electrical cords but also ties up many outlets that may be needed for other purposes.

As such, a need currently exists for an improved lighting system for direct wiring a plurality of UL listed portable electric luminaires. In particular, a need exists for a lighting system for direct wiring a plurality of portable electric luminaires, such as in undercabinet lighting applications, while still meeting UL standards and requirements.

SUMMARY OF THE INVENTION

The present invention is generally directed to a lighting system for direct wiring a plurality of electric luminaires, such as a plurality of UL listed portable electric luminaires.

For example, in one embodiment, the plurality of electric luminaires may comprise a plurality of lighting fixtures that include a mounting device for mounting the fixtures to an adjacent surface, such as under a set of cabinets. The light fixtures, in one embodiment, can include tubular fluorescent bulbs having a diameter of less than about 0.75 inches. For example, in one embodiment, the fluorescent lighting fixtures can include T5 bulbs that have a diameter of ⅝ inch and a length, for instance, of from about 4 inches to about 24 inches. In undercabinet lighting applications, T5 fluorescent bulbs are typically rated at from about 2 watts to about 13 watts and emit light at a wavelength of from about 300 nm to about 500 nm.

It should be understood, however that various other light fixtures may be used with the system of the present invention. For example, in other embodiments, the light fixtures may be designed to hold incandescent bulbs.

In connecting a plurality of electric luminaires, the system of the present invention includes a wire modular box comprising a hardwire receiving station. The hardwire receiving station includes a positive terminal, a negative terminal, and a ground for mating with a hardwire source. The wire modular box includes one or more receptacles that are electrically connected to the hardwire receiving station. In one particular embodiment, the wire modular box includes a circuit board for connecting the receptacles to the hardwire receiving station. When the circuit board is present, the receptacles can be mounted onto the board. Further, the hardwire receiving station can include push-in wire connectors that are also mounted to the circuit board.

The wire modular box is adapted to be electrically connected to a plurality of lamp receiving devices, such as portable luminaires as described above. Each lamp receiving device may include a first receptacle positioned on one side of the device and a second receptacle positioned on an opposite side of the device. A plurality of cables are included for making electrical connections as needed between the wire modular box and a lamp receiving device and between two adjacent lamp receiving devices. Each cable may include first and second plugs positioned on opposite ends of the cable.

According to the present invention, each plug on a cable may form a quick connect with a corresponding receptacle located on the wire modular box and/or on the lamp receiving devices. Each receptacle and plug includes a positive terminal, a negative terminal, and a ground. Other features and aspects of the present invention are discussed in greater detail below.

BRIEF DESCRIPTION OF THE DRAWINGS

A full and enabling disclosure of the present invention, including the best mode thereof, to one of ordinary skill in the art, is set forth more particularly in the remainder of the specification, including reference to the accompanying figures, in which.

Figure 1:
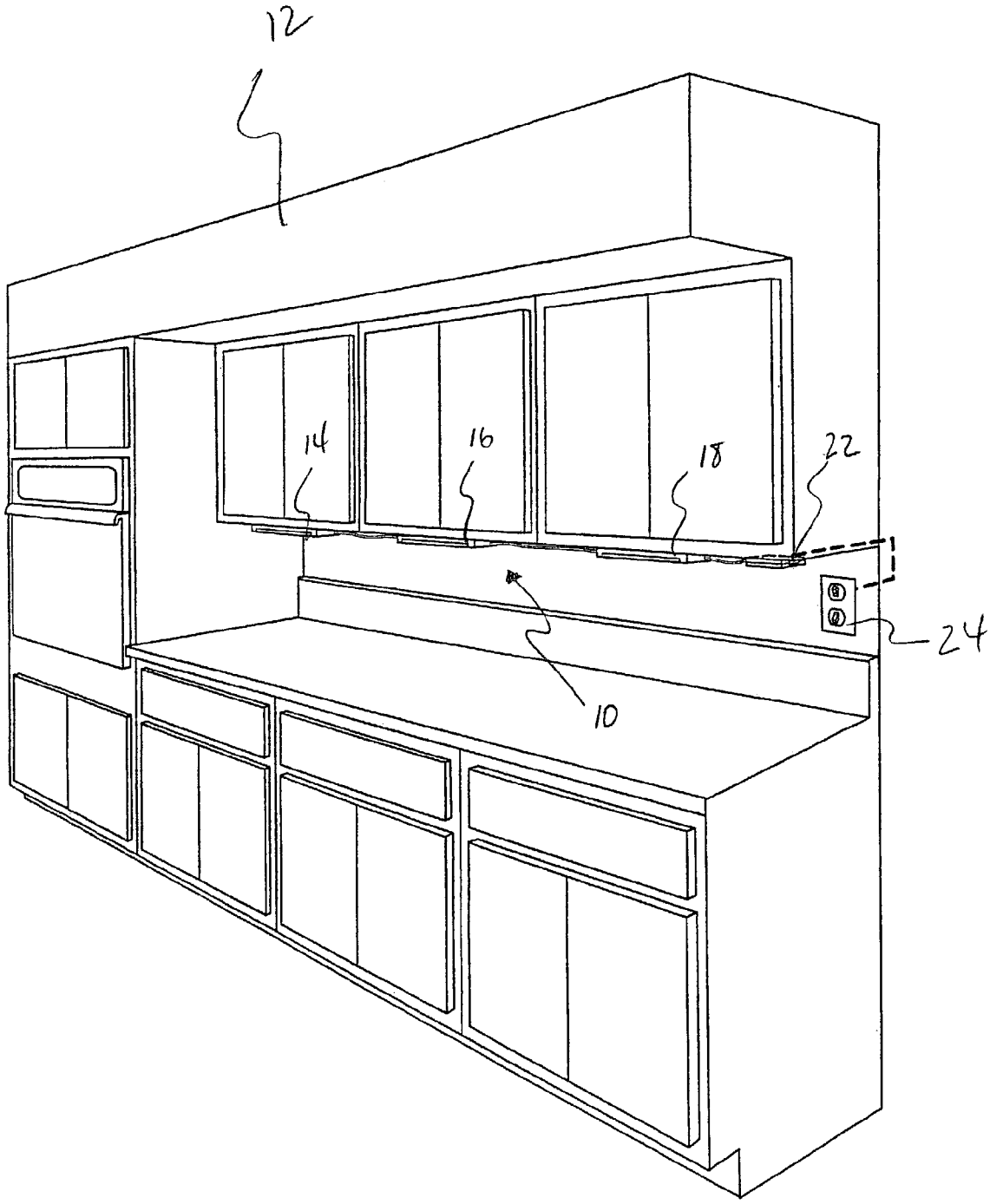
FIG. 1 is a perspective view of a lighting system made in accordance with the present invention shown mounted below a plurality of cabinets.

Repeated use of reference characters in the present specification and drawings is intended to represent the same or analogous features or elements of the invention.

DETAILED DESCRIPTION OF PREFERRED EMBODIMENTS

It is to be understood by one of ordinary skill in the art that the present discussion is a description of exemplary embodiments only, and is not intended as limiting the broader aspects of the present invention.

The present invention is generally directed to a lighting system for direct wiring a plurality of light fixtures. For example, the present invention is particularly well suited for direct wiring a plurality of portable electric luminaires as categorized by Underwriters Laboratories (UL Classification No. 153). Such portable electric luminaires are not intended, according to UL, for installation in recessed walls or ceilings, or in permanently installed cabinets where wiring is concealed or passed through openings in the structure.

Within the above guidelines, the system of the present invention allows for a plurality of portable electric luminaires to be easily installed and connected. In general, the electric luminaires in the system of the present invention connect to a common wire modular box that is adapted to receive a direct wire from the facility where the lights are being installed. Further, according to the present invention, the electric luminaires are connected using "quick-connects" that may comprise, for instance, a male receptacle and a corresponding female receptacle that provide a positive terminal connection, a negative terminal connection, and a ground connection.

In one embodiment of the present invention, for instance, the lighting assembly includes a wire modular box containing at least two integral receptacles and a hardwire receiving station configured to be connected to an electrical source. The lighting assembly further includes a plurality of light fixtures that each also include at least two receptacles. In order to connect the light fixtures in series and to connect the light fixtures to the wire modular box, the lighting assembly further includes a plurality of cord assemblies that each include two plugs located on opposite ends. The plugs are designed to fit into the receptacles contained on the light fixtures and on the wire modular box. For instance, in one embodiment, the plugs on the cord form quick disconnect connections with the receptacles on the light fixtures and on the wire modular box.

Although the lighting system can be used in various applications, FIG. 1 illustrates one embodiment of an under-cabinet lighting system made in accordance with the present invention. As shown in FIG. 1, a lighting system generally 10 made in accordance with the present invention is shown mounted below a row of cabinets 12. In this particular embodiment, the lighting system 10 includes three light fixtures 14, 16 and 18 which may be, for instance, portable electric luminaires. The light fixtures 14, 16 and 18 are electrically connected to a wire modular box 22 which is hardwired to the electrical system of the facility. In this embodiment, the wire modular box 22 is also electrically connected to a switch 24. Switch 24 can be configured to turn the light fixtures on and off at a single location.

Figure 2:
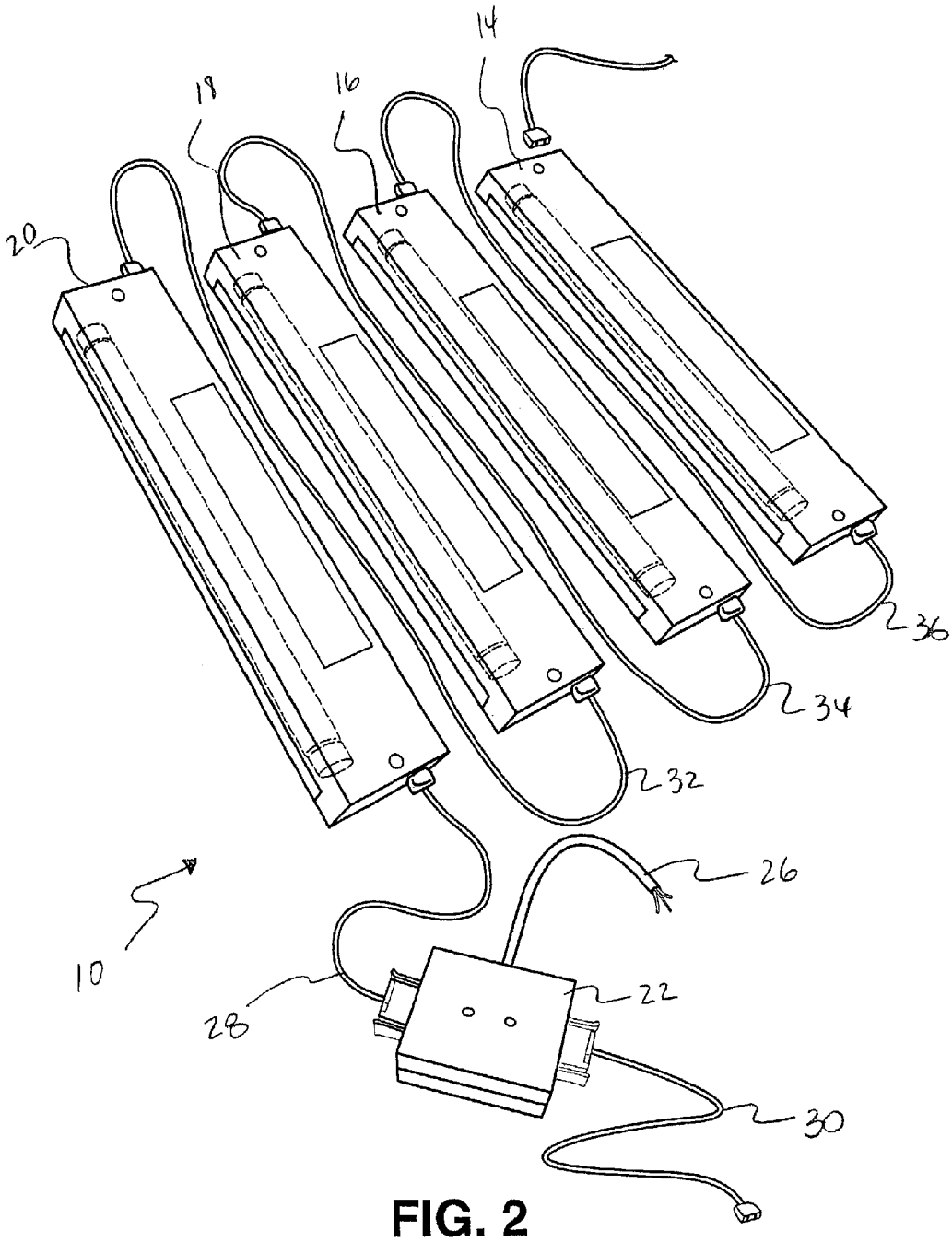
FIG. 2 is a perspective view of one embodiment of a lighting system made in accordance with the present invention.

Referring to FIG. 2, an isolated view of the lighting system illustrated in FIG. 1 is shown. As illustrated in FIG. 2, the lighting system 10 includes a wire modular box 22 in electrical communication with light fixtures 14, 16, 18 and 20. The wire modular box 22 is adapted to receive a supply wire 26 originating from the facility or home where the lighting system is being installed. The wire modular box 22 is also configured to be connected to one or more light fixtures. For instance, as shown in FIG. 2, the wire modular box 22 includes two receptacles positioned on either end of the wire modular box. A cable 28 connects the wire modular box 22 from the receptacle on the box to an inlet receptacle on the light fixture 20. Similarly, cable 30 is configured to connect the wire modular box 22 to a further light fixture if desired.

Each light fixture 14, 16, 18 and 20 includes a first receptacle on one end and a second receptacle at an opposite end. The receptacles located on each light fixture may be the same or different than the receptacles located on the wire modular box. For simplicity, in most applications, the receptacles on the light fixture should be the same as the receptacles on the wire modular box. In this manner, as shown, the light fixtures 14, 16, 18 and 20 can be interconnected for providing electrical power to the light fixtures originating from the wire modular box 22. Specifically, light fixture 20 is connected to light fixture 18 via cable 32. Light fixture 18 is connected to light fixture 16 via cable 34, while light fixture 16 is connected to light fixture 14 via cable 36. In order to make the proper electrical connections, each cable includes a first plug at one end and a second plug at an opposite end.

As described above, the system of the present invention is particularly well suited for use with portable electric luminaires as may be classified by Underwriters Laboratories. Portable luminaires may include portable lamps, lampshades, nightlights, portable work lights, office furnishing lights, and the like. Portable luminaires can include an incandescent or a fluorescent lamp or bulb that are typically rated at 300 watts or less. A portable electric luminaire classified by Underwriters Laboratories is not permitted by its UL listing to be wired directly to a supply wire of a facility, such as a home. Further, as described above, the wiring cannot be concealed or passed through openings in a structure. The lighting system of the present invention provides a convenient and efficient system for connecting a plurality of portable electric luminaires together that can be controlled by a single switch while still meeting all of the requirements of Underwriters Laboratories.

As shown in FIGS. 1 and 2, in one embodiment, the system of the present invention utilizes portable fluorescent luminaires. For instance, in one embodiment, the fluorescent luminaires can be configured to receive tubular fluorescent bulbs. The fluorescent bulbs can have a diameter of less than about 0.75 inches, such as less than about 0.5 inches. For instance, in one embodiment, the fluorescent luminaires are designed to operate with T5 fluorescent bulbs, which have a diameter of ⅝ inch. The length of the fluorescent bulbs can vary depending upon the particular application. For instance, the bulbs can be from about 4 inches to about 48 inches long, particularly from about 4 inches to about 24 inches long, and more particularly from about 6 inches to about 20 inches long.

Fluorescent bulbs as described above are commercially available in power ratings of 2 watts, 4 watts, 6 watts, 8 watts or 13 watts. The fluorescent bulbs typically emit light at a wavelength of from about 300 nm to about 500 nm. It should be understood, however, that various other fluorescent bulbs may be used in the light system of the present invention.

Figure 3:
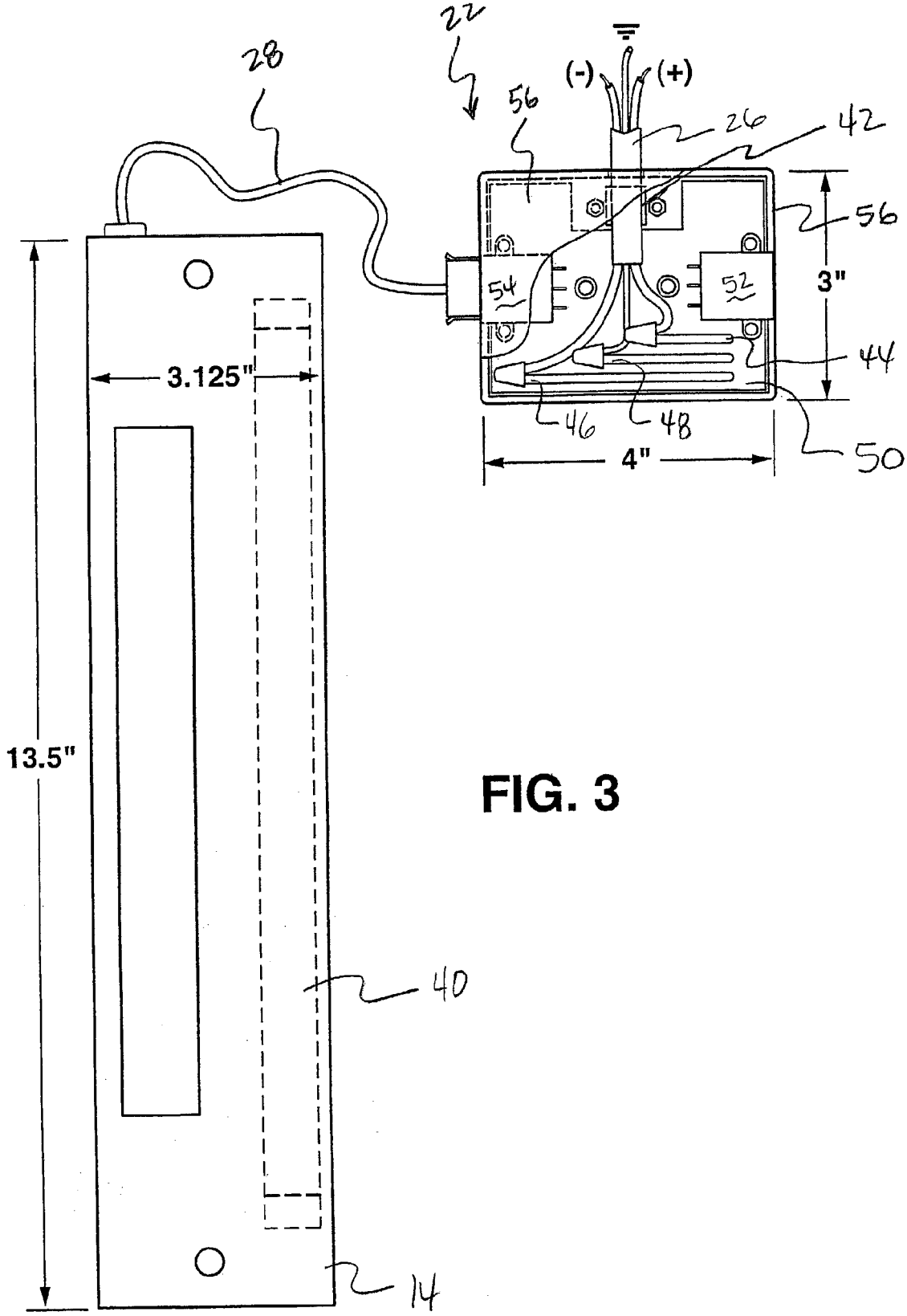
FIG. 3 is a plan view with cut away portions of one embodiment of a wire modular box and a light receiving device made in accordance with the present invention.

Referring to FIG. 3, one embodiment of a fluorescent light fixture 14 that may be incorporated into the present invention is illustrated including the representative dimensions of the fixture. The dimensions included with the figure, however, are merely provided for purposes of illustration and are not intended to limit the invention. As shown in phantom, the fluorescent light fixture 14 includes a tubular fluorescent bulb 40.

In order to mount the light fixture 14 to an adjacent surface, the light fixture can include a mounting device which can be, for instance, a bracket or simply an aperture for receiving a screw or bolt. As shown in FIG. 1, for instance, the fluorescent light fixture 14 can be mounted below a cabinet for illuminating a countertop.

In FIG. 3, the wire modular box 22 is illustrated in greater detail. The wire modular box 22 receives the supply wire 26 which includes a positive wire, a negative wire, and a ground. In order to hold the supply wire 26 in place, the wire modular box 22 can include a clamp 42. From the clamp 42, the positive lead, negative lead and ground of the supply wire 26 are connected to a corresponding positive terminal 44, negative terminal 46 and ground 48 included in the wire modular box 22.

In one particular embodiment of the present invention as shown in FIG. 3, the wire modular box 22 can include a circuit board 50 that connects the positive terminal 44, the negative terminal 46 and the ground 48 with a pair of opposing receptacles 52 and 54. For instance, the receptacles 52 and 54 can be mounted onto the circuit board 50 in electrical communication with the terminals 44 and 46 and the ground 48.

Incorporating a circuit board 50 into the wire modular box 22 provides various benefits and advantages. For instance, the circuit board 50 facilitates connections between the terminals 44 and 46, the ground 48 and the supply wire 26. Further, by incorporating a circuit board 50 into the wire modular box 22, the thickness of the wire modular box can be minimized. For instance, the thickness of the wire modular box can be less than about 1 inch, such as from about 0.5 inches to about 0.875 inches. In other embodiments, however, the thickness of the wire modular box can be made even smaller by incorporating thinner output receptacles.

As described above, the wire modular box 22 includes, in this embodiment, two receptacles 52 and 54. Each receptacle is configured to receive a corresponding plug for electrically connecting a light fixture. More or less receptacles can be included in the wire modular box as desired.

The wire modular box 22 is contained within a housing 56. The housing 56 can be made from any suitable material, such as aluminum or a plastic material. The housing 56 can include a mounting device for mounting the wire modular box to an adjacent surface, such as a wall.

Figure 4:
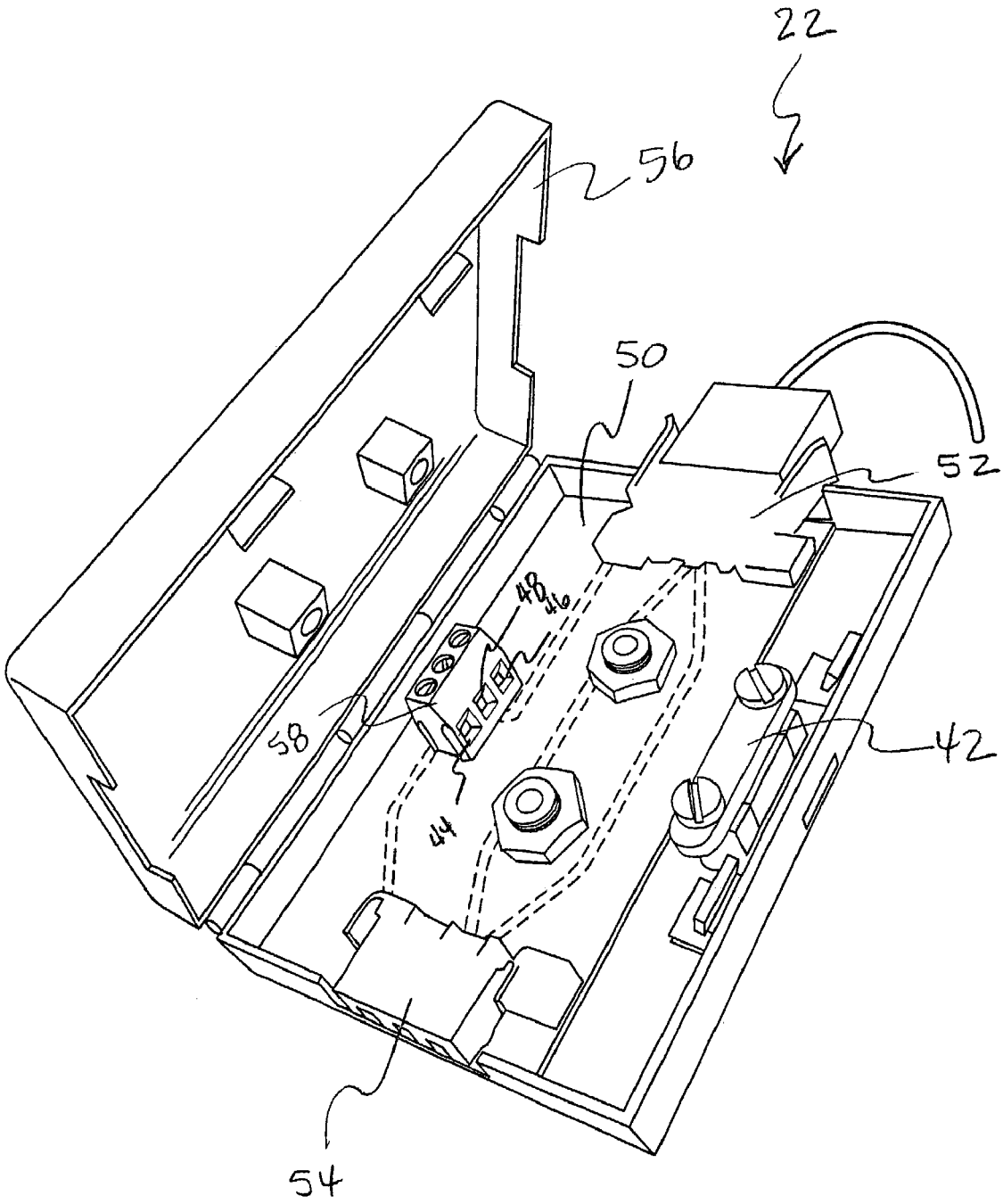
FIG. 4 is a perspective view of another embodiment of a wire modular box made in accordance with the present invention.

Referring to FIG. 4, an alternative embodiment of a wire modular box 22 is shown. Like reference numerals have been used to indicate similar elements of the wire modular box illustrated in FIG. 3. In this embodiment, the electrical connections contained within the circuit board 50 are shown in phantom. Mounted on the circuit board 50 in this embodiment is a supply wire connector 58 including a plurality of push-in wire connections. Specifically, the supply wire connector 58 includes a positive terminal 44, a negative terminal 46, and a ground 48. The supply wire connector 58 as shown in FIG. 4 facilitates connection between the wire modular box 22 and a supply wire. Similar to the receptacles 52 and 54, the supply wire connector 58 can be mounted directly to the circuit board 50.

As shown in FIGS. 2 and 3, the light fixtures and the wire modular box are connected using a plurality of cables. The various components include receptacles and corresponding plugs for making connections between the components. In one embodiment, the receptacles and plugs form a quick-connect.

Figure 5:
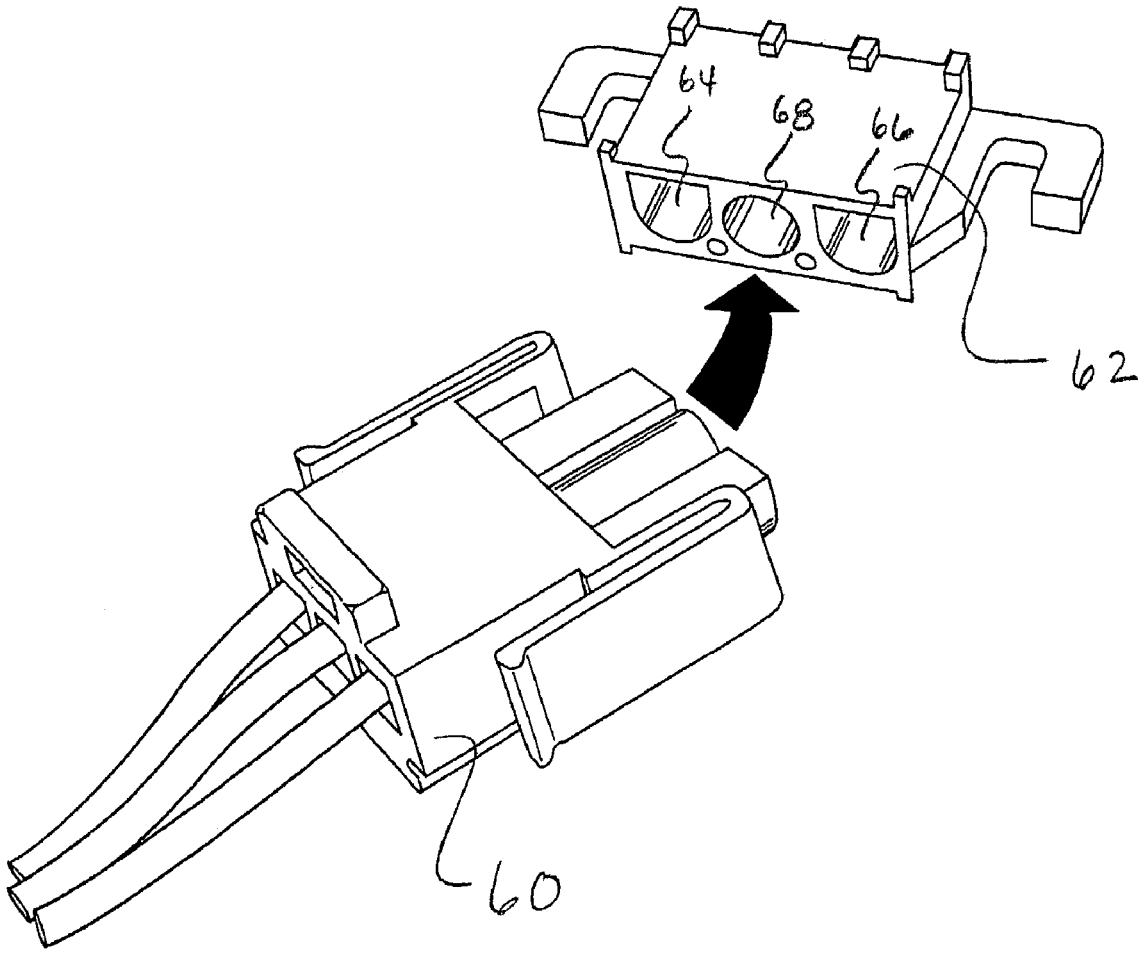
FIG. 5 is a perspective view of one embodiment of an input receptacle and a corresponding plug made in accordance with the present invention.

Referring to FIG. 5, one embodiment of a male plug 60 and a female plug receptacle 62 are shown. The receptacle 62 includes a positive terminal 64, a negative terminal 66, and a ground 68. Plug 60 includes corresponding terminals. It should be understood, that in other embodiments, the receptacles may be male connectors while the plugs may be female connectors.

The shape of the terminals can vary depending upon the particular application. In this embodiment, for instance, positive terminal 64 and negative terminal 66 have non-circular shapes, while ground 68 includes a circular shape. In other embodiments, however, various other geometric configurations can be used. For instance, all of the terminals can have a circular shape. Alternatively, each terminal can have a different geometric configuration, which may help insure that the proper connections are made when the plug 60 is inserted into the receptacle 62.

Throughout the lighting system of the present invention, each of the connections include a ground. By connecting each of the light fixtures to a ground, the entire system becomes grounded, which is also known as an earthed system. The ground provides a common return for the electric circuit and acts as an arbitrary zero of potential. In this manner, any electrical shorts that occur in the system become dissipated increasing the safety of the system.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in the appended claims.

What is claimed is:

1. A lighting system for direct wiring a plurality of UL listed portable electric luminaires comprising:

a wire modular box comprising a hardwire receiving station, the hardwire receiving station including a positive terminal, a negative terminal and a ground for mating with a hardwire source, the wire modular box including at least two receptacles and a circuit board, the circuit board electrically connecting the hardwire receiving station to each of the receptacles;

a plurality of lamp receiving devices, each lamp receiving device being configured to receive a fluorescent bulb, each lamp receiving device including a first receptacle and a second receptacle;

a plurality of cables for making electrical connections as needed between the wire modular box and a lamp receiving device and between two lamp receiving devices, each cable including a first plug at one end and a second plug at an opposite end; and wherein each plug forms a quick-connect with a corresponding receptacle, each receptacle and each plug including a positive terminal, a negative terminal, and a ground.

2. A lighting system as defined in claim 1, wherein the wire modular box includes a housing for containing the hardwire receiving station and the circuit board.

3. A lighting system as defined in claim 2, wherein the housing is made from aluminum.

4. A lighting system as defined in claim 2, wherein the housing is made from plastic.

5. A lighting system as defined in claim 1, wherein the receptacles contained in the wire modular box are mounted on the circuit board.

6. A lighting system as defined in claim 1, wherein the hardwire receiving station includes push-in wire connectors.

7. A lighting system as defined in claim 1, wherein the receptacles are positioned on opposite ends of the wire modular box.

8. A lighting system as defined in claim 1, further comprising a plurality of fluorescent bulbs having a diameter of less than about 0.75 inches.

9. A lighting system as defined in claim 8, wherein the fluorescent bulbs comprise T5 bulbs.

10. A lighting system as defined in claim 8, wherein the fluorescent bulbs have a power rating of from about 2 watts to about 13 watts.

11. A lighting system as defined in claim 1, wherein each lamp receiving device includes a mounting device for mounting the lamp receiving device to an adjacent surface.

12. A lighting system as defined in claim 1, wherein the first receptacle and the second receptacle on each lamp receiving device are positioned on opposite ends of the lamp receiving device.

13. A lighting system as defined in claim 1, wherein each receptacle comprises a female connector while each plug comprises a male connector.

14. A lighting system as defined in claim 1, wherein one of the terminals located on each of the receptacles and each of the plugs is circular while the remaining two terminals are non-circular.

15. A lighting system for direct wiring a plurality of portable electric luminaires comprising;

a wire modular box comprising a hardwire receiving station, the hardwire receiving station including a positive terminal, a negative terminal, and a ground for mating with a hardwire source, the wire modular box including at least two receptacles in electrical communication with the hardwire receiving station;

a plurality of electric luminaires, each of the electric luminaires including a mounting device for mounting the electric luminaire against an adjacent surface, each electric luminaire including a first receptacle and a second receptacle; and a plurality of cables for making electrical connections as needed between the wire modular box and an electric luminaire and between two electric luminaires, each cable including a first plug at one end and a second plug at an opposite end.

16. A lighting system as defined in claim 15, wherein the electric luminaires comprise under cabinet luminaires containing fluorescent bulbs.

17. A lighting system as defined in claim 16, wherein the fluorescent bulbs have a diameter of less than about 0.75 inches.

18. A lighting system as defined in claim 15, wherein the wire modular box includes a circuit board, the circuit board electrically connecting the hardwire receiving station to each of the receptacles.

19. A lighting system as defined in claim 18, wherein the wire modular box includes a housing for containing the hardwire receiving station and the circuit board.

20. A lighting system as defined in claim 15, wherein the hardwire receiving station includes push-in wire connectors.

21. A lighting system as defined in claim 16, wherein the fluorescent bulbs comprise T5 bulbs.

22. A lighting system as defined in claim 16, wherein the fluorescent bulbs have a power rating of from about 2 watts to about 13 watts.

23. A lighting system as defined in claim 15, wherein each receptacle comprises a female connector while each plug comprises a male connector.

24. A lighting system as defined in claim 15, wherein each receptacle and each plug includes a positive terminal, a negative terminal, and a ground.

25. A lighting system as defined in claim 24, wherein one of the terminals located on each of the receptacles and each of the plugs is circular while the remaining two terminals are non-circular.

26. A lighting system as defined in claim 15, wherein the electric luminaires contain incandescent bulbs.

27. A lighting system comprising:

(a) a wire modular box comprising:

a hardwire receiving station, the hardwire receiving station including a positive terminal, a negative terminal, and a ground for mating with a hardwire source;

at least two output receptacles configured to create a quick connect with a corresponding plug, the output receptacles including a positive terminal, a negative terminal, and a ground;

a circuit board electrically connecting the hardwire receiving station to each of the output receptacles; and a housing for containing the hardwire receiving station and the circuit board;

(b) a plurality of electric luminaires, each electric luminaire including a first receptacle and a second receptacle; and (c) a plurality of cables for making electrical connections as needed between the wire modular box and an electric luminaire and between two electric luminaires, each cable including a first plug at one end and a second plug at an opposite end.

28. A wire modular box as defined in claim 27, wherein the housing comprises aluminum.

29. A wire modular box as defined in claim 27, wherein the housing comprises a plastic material.

30. A wire modular box as defined in claim 27, wherein the hardwire receiving station includes push-in wire connectors.

31. A wire modular box as defined in claim 27, wherein at least two of the terminals contained on the output receptacle have different geometric shapes.

32. A wire modular box as defined in claim 27, wherein two of the terminals on the output receptacles are circular while one terminal is non-circular.

* * * * *